US008376363B1

(12) United States Patent
Lizotte

(10) Patent No.: US 8,376,363 B1
(45) Date of Patent: Feb. 19, 2013

(54) BOARD GAME USING CHAINS

(76) Inventor: Norman A. Lizotte, Foster, RI (US)

( * ) Notice: Subject to any disclaimer, the term of this patent is extended or adjusted under 35 U.S.C. 154(b) by 0 days.

(21) Appl. No.: 13/526,119

(22) Filed: Jun. 18, 2012

(51) Int. Cl.
*A63F 3/00* (2006.01)

(52) U.S. Cl. ..... 273/248; 273/287

(58) Field of Classification Search ..... 273/236, 273/248, 287, 276, 249
See application file for complete search history.

(56) References Cited

U.S. PATENT DOCUMENTS 1,240,756 A * 9/1917 Moore ..... 273/243
3,643,957 A * 2/1972 Bryant ..... 273/249
4,004,810 A * 1/1977 Henrie ..... 273/249
D243,544 S 3/1977 Hope
4,223,892 A * 9/1980 Matherne ..... 273/248
4,477,080 A * 10/1984 Baker ..... 273/241
4,778,186 A 10/1988 Dudley
4,927,147 A 5/1990 Delzio
4,998,735 A * 3/1991 Blackwell, III ..... 273/249
5,135,234 A 8/1992 Finch
5,454,569 A * 10/1995 Walker ..... 273/236
5,709,384 A * 1/1998 Miller ..... 273/256
6,279,909 B1 8/2001 Alexander, II et al.
7,896,347 B1 3/2011 Vail

* cited by examiner

*Primary Examiner* — Vishu K. Mendiratta

(57) ABSTRACT

A game, effective for stimulating enjoyment and interaction between family and friends, the game comprising a game board, a timer, a deck of cards, five game pieces, and a set of chains wherein players are divided into teams and one player from each team is designated a chain handler, where the chain handler must use a chain to describe words drawn from one of the cards and the other players on the chain handler's team must guess the word being drawn with the chain.

5 Claims, 3 Drawing Sheets

BOARD GAME USING CHAINS

BACKGROUND OF THE INVENTION

The present invention relates generally to family board games, and more particularly, word guessing games which require teams to guess words drawn from a deck of cards where one of the members of the team provides hints to the other members of the team, based on a subject word selected from a card, so that the team might guess the subject word.

The prior art discloses some word guessing games where teams try to identify specific words corresponding to hints provided by team mates, for example, hints drawn on a board. For example, Pictionary, a well known game, requires teams to guess words corresponding to drawings made by a teammate, where the drawings are made using a pencil and paper.

Despite such prior art, it is believed that there is a need for a word guessing game that does not require the use of a writing utensil and paper and that also includes other novel and useful features.

SUMMARY OF THE INVENTION

The present invention features a game board, a chain, a deck of cards, a plurality of game pieces and a timer. The aforementioned components can, in some embodiments be designed to represent or make references to a chain, as an additional and creative component of the present invention.

Chains do not need to be replenished, as would writing utensils and paper. Chains are capable of manipulation and can be shaped in ways that might represent a particular word.

As such, chains can take the place of a pencil and paper. Thus, one of the players on a team can manipulate the shape of the chain with the goal that the other teammates guess a particular word based upon the shape of the chain.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
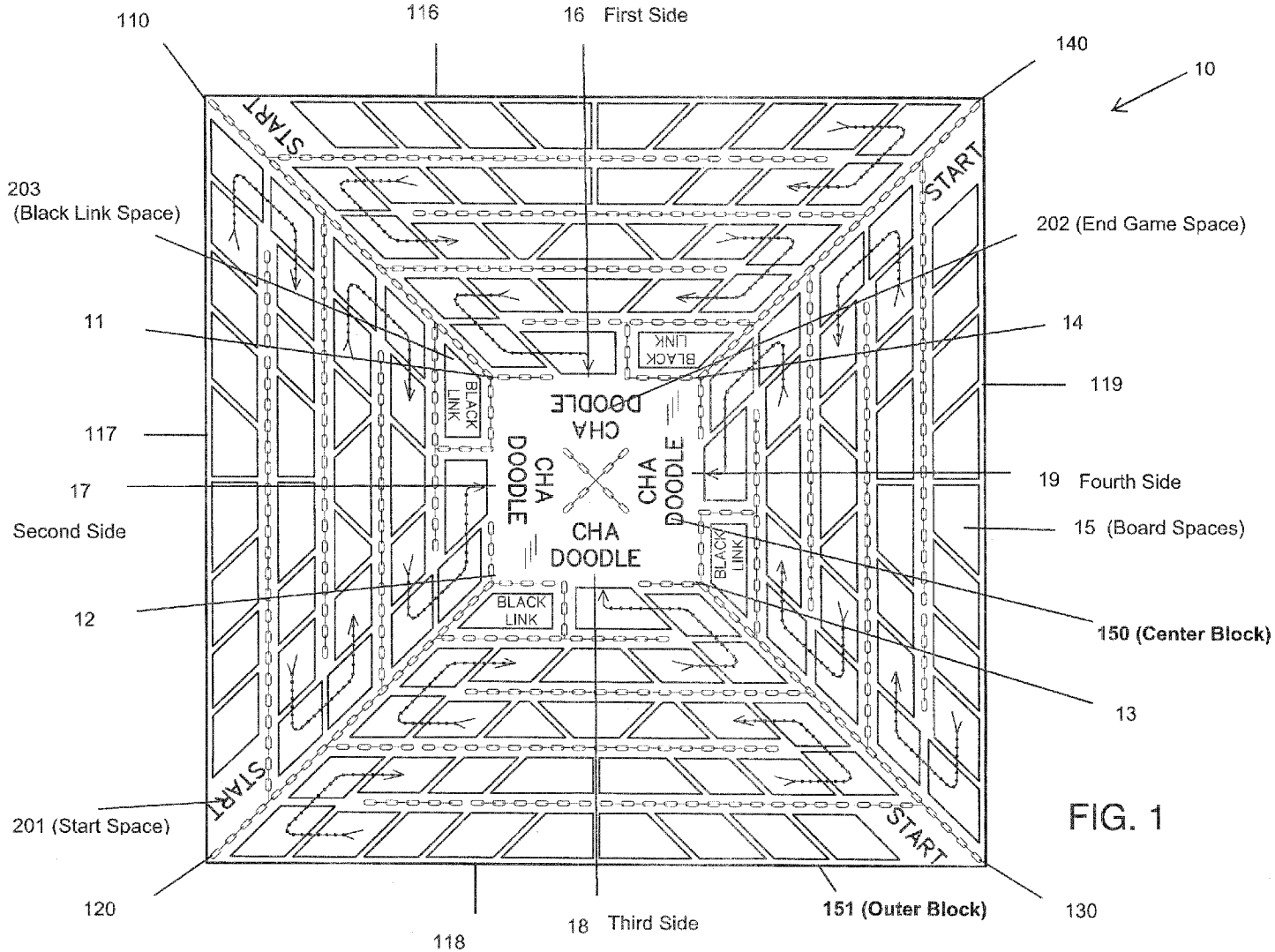
FIG. 1 is a first view of the game board of the present invention.
Figure 3:
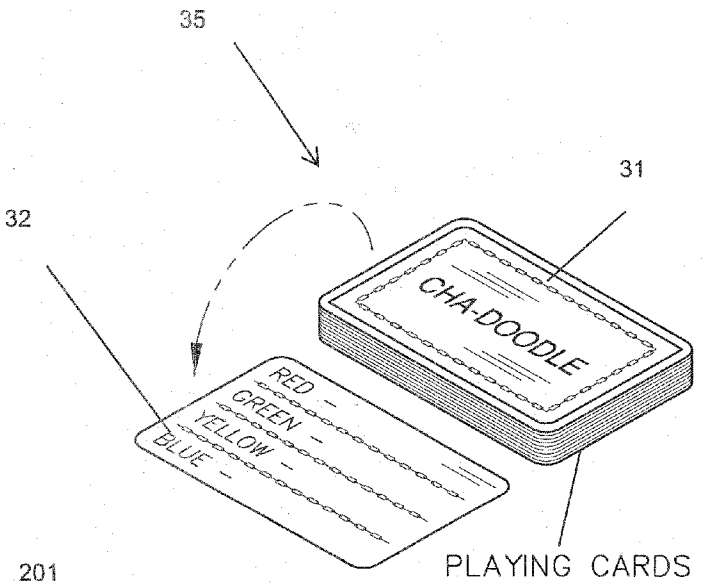
FIG. 3 is a view of one of the cards and the chain/s of the present invention.
Figure 3:
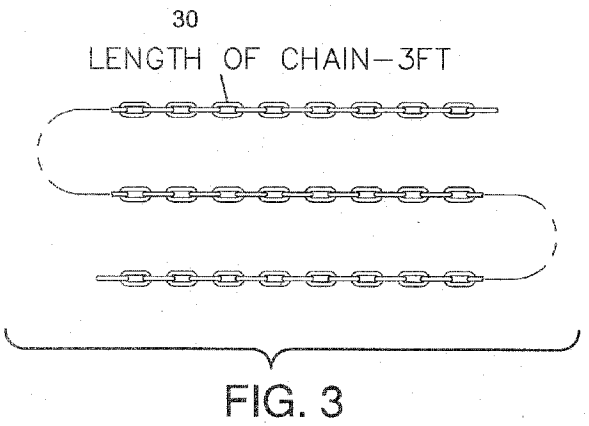
Figure 2:
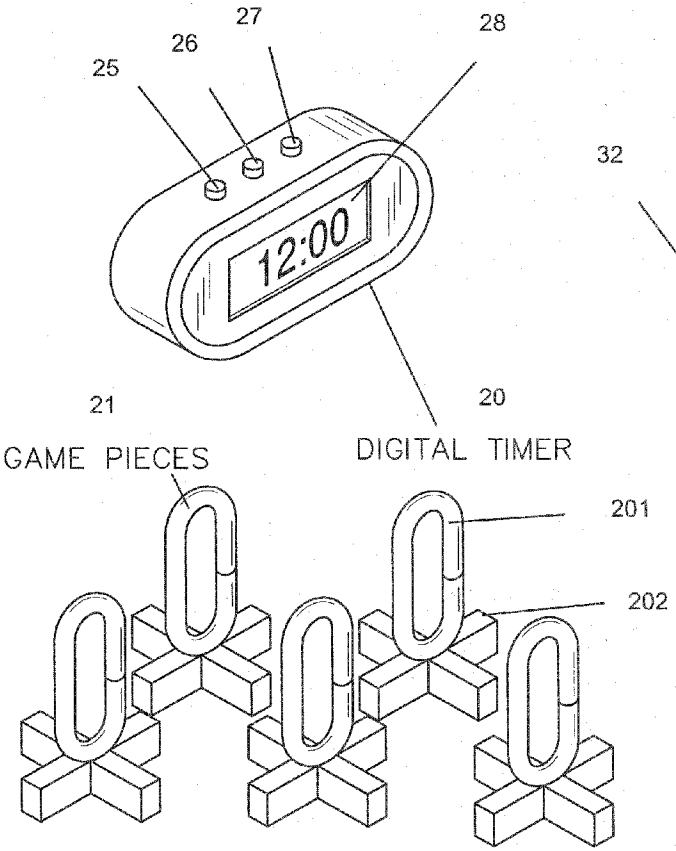
FIG. 2 is a view of the timer and game pieces of the present invention.
Figure 4:
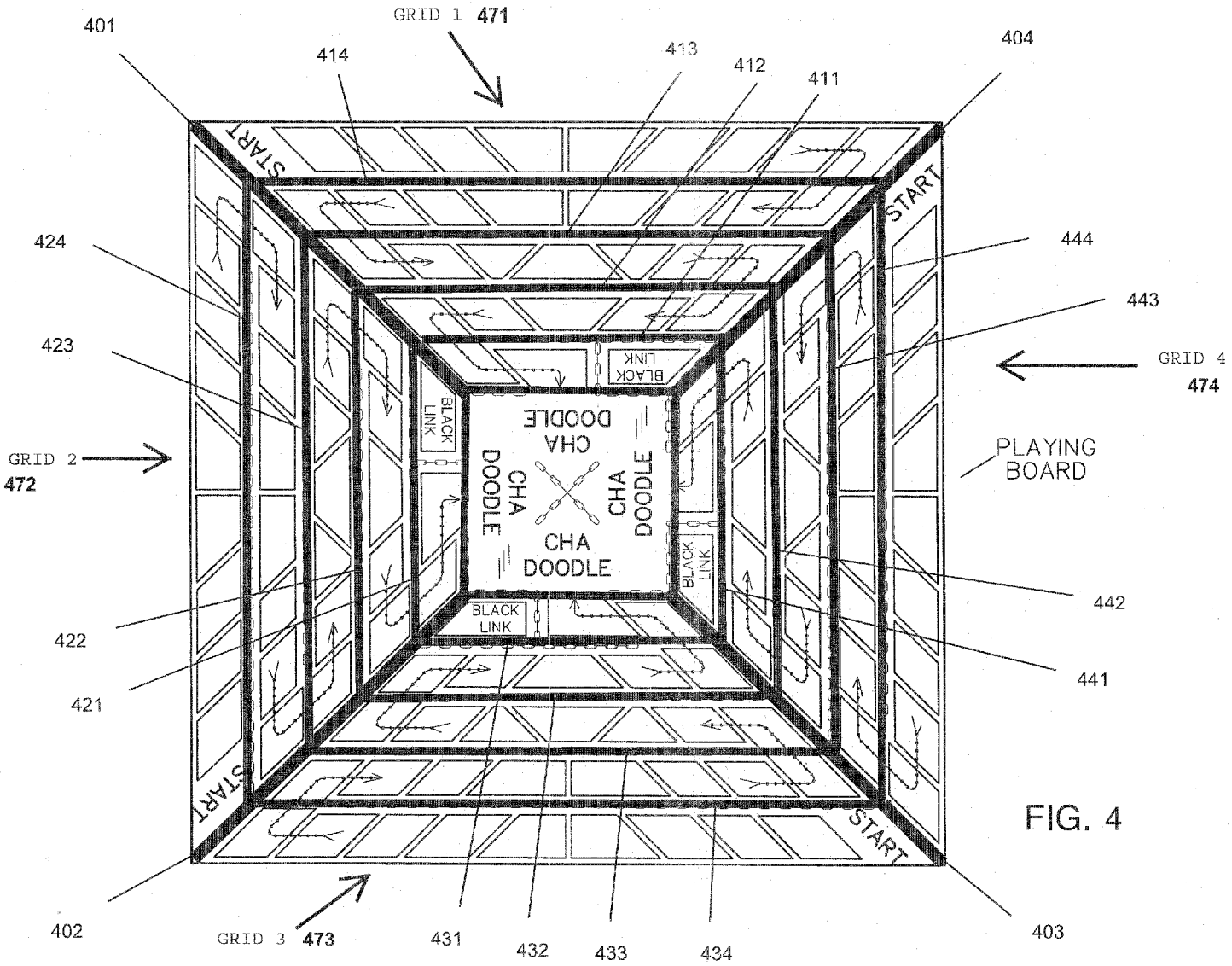
FIG. 4 is a second view at the game board of the present invention.

Referring now to FIGS. 1-4, the present invention features, in some embodiments, a game, effective for stimulating enjoyment and interaction between family and friends. The game can comprise, but is not limited to the following features.

In some broad embodiments, the present invention features a game board [10] comprising a flat front surface, a center block [150] comprising a first side [16], second side [17], third side [18], and fourth side [19], the center block further comprising a first center block corner [11], a second center block corner [12], a third center block corner [13] and a fourth center block corner [14], the center block bordered by an outer block [151], the outer block [151] comprising a first outer block corner [110], a second outer block corner [120], a third outer block corner [130] and a fourth outer block corner [140], the game board further comprising a first path [401] formed by a straight line extending from the first center block corner [11] to the first outer block corner [111], the game board further comprising a second path [402] formed by a straight line extending from the second center block corner [12] to the second outer block corner [112], the game board further comprising a third path [402] formed by a straight line extending from the third center block corner [13] to the third outer block corner [113], the game board further comprising a fourth path [404] formed by a straight line extending from the fourth center block corner [14] to the fourth outer block corner [114], the game board further comprising a first trapezoid grid [471] formed by the first center block side [16], the first outer block side [116], the first path [401], and the fourth path [404], the game board further comprising a second trapezoid grid [471] formed by the second center block side [17], the second outer block side [117], the first path [401] and the second path [402], the game board further comprising a third trapezoid grid [473] formed by the third center block side [18], the third outer block side [118], the second path [402] and the third path [403], the game board further comprising a fourth trapezoid grid [474] formed by the fourth center block side [19], the fourth outer block side [119], the third path [403] and the fourth path [404].

The center and outer blocks can be graphical emblems inscribed on the game board where the center block is located at the center of the outer block. The outer block can essentially describe the game board itself where the center block is the location of the board that the teams try to reach first—given that it is the location where end game pieces area.

The aforementioned embodiment describes how the game board can be broken into four trapezoid shaped grids, one grid for each team, where each grid comprises a plurality, or chain of board spaces through which a team must traverse in order to win the game.

In some embodiments, the game further comprises a first trapezoid grid [471] comprising a first horizontal line [411] extending from the first path [401] to the fourth path [404] at a first distance from the center block [150], the first trapezoid grid [471] comprising a second horizontal line [412] extending from the first path [401] to the fourth path [404] at a second distance from the center block [150], the first trapezoid grid [471] comprising a third horizontal line [413] extending from the first path [401] to the fourth path [404] at a third distance from the center block [150], the first trapezoid grid [471] comprising a fourth horizontal line [414] extending from the first path [401] to the fourth path [404] at a fourth distance from the center block [150].

In some embodiments, the game further comprises the second trapezoid grid [472] comprising a first horizontal line [421] extending from the first path [401] to the second path [402] at the first distance from the center block [150], the second trapezoid grid [472] comprising a second horizontal line [422] extending from the first path [401] to the second path [402] at the second distance from the center block [150], the second trapezoid grid [472] comprising a third horizontal line [423] extending from the first path [401] to the second path [402] at the third distance from the center block [150], the second trapezoid grid [472] comprising a fourth horizontal line [424] extending from the first path [401] to the second path [402] at the fourth distance from the center block [150];

In some embodiments, the game further comprises the third trapezoid grid [473] comprising a first horizontal line [431] extending from the second path [402] to the third path [403] at the first distance from the center block [150], the third trapezoid grid [473] comprising a second horizontal line [432] extending from the second path [402] to the third path [403] at the second distance, from the center block [150], the third trapezoid grid [473] comprising a third horizontal line [433] extending from the second path [402] to the third path [403] at the third distance from the center block [150], the third trapezoid grid [473] comprising a fourth horizontal line [434] extending from the second path [402] to the third path [403] at the fourth distance from the center block [150];

In some embodiments, the game further comprises the fourth trapezoid grid [474] comprising a first horizontal line [441] extending from the third path [403] to the fourth path [404] at the first distance from the center block [150], the fourth trapezoid grid [474] comprising a second horizontal line [442] extending from the third path [403] to the fourth path [404] at the second distance from the center block [150], the fourth trapezoid grid [474] comprising a third horizontal line [443] extending from the third path [403] to the fourth path [404] at the third distance from the center block [150], the fourth trapezoid grid [474] comprising a fourth horizontal line [444] extending from the third path [403] to the fourth path [404] at the fourth distance from the center block [150].

The aforementioned embodiment describes the different levels created by the horizontal lines of each grid. The recited game board spaces can weave through the levels created by the horizontal lines, beginning with the spaces in the level on the outermost portion of each grid and ending at the final space on the innermost level most closest to the center block where the spaces end, for each grid, at an end game space. The direction of the game pieces through the interconnected board spaces, and movement up the levels formed by the lines, is guided by a plurality of bended arrows inscribed on the board as shown in FIG. 1, starting with a first bended arrow at the corner of grid opposite the corner of the grid comprising the start game space for that grid.

In some embodiments, the game board [10] further comprises a first series of interlinking board spaces disposed within the first trapezoid grid [471], the first series further comprising, a start space [201] comprising a first color which is the first of the interlinking board spaces [15] and an end game space [202] which is the final board space, and a first plurality of black spaces [203] disposed at predetermined locations within the first series, the game board [10] further comprising a second series of interlinking board spaces disposed within the second trapezoid grid [472], the second series further comprising, a start space [201] comprising a second color which is the first of the interlinking board spaces [15] and the end game space [202] which is the final board space, and a second plurality of black spaces [203] disposed at predetermined locations within the second series, the game board [10] further comprising a third series of interlinking board spaces disposed within the third trapezoid grid [473], the third series further comprising, a start space [201] comprising a third color which is the first of the interlinking board spaces [15] and the end game space [202] which is the final board space, and a third plurality of black spaces [203] disposed at predetermined locations within the third series, the game board [10] further comprising a fourth series of interlinking board spaces disposed within the fourth trapezoid grid [474], the fourth series further comprising, a start space [201] comprising a fourth color which is the first of the interlinking board spaces [15] and the end game space [202] which is the final board space, and a fourth plurality of black spaces [203] disposed at predetermined locations within the fourth series.

In some embodiments, said interlinking board spaces [15] in each series forming a chain weaving from an outer corner of each of the respective grids to the center block [150].

The aforementioned embodiment describes how the interlinking board spaces weave through each grid; the interlinking board spaces beginning with a start space at a corner of the grid, and the spaces weaving through the lines and ending at a end game space at the center block. Several black spaces can be disposed at predetermined locations along the interconnecting board spaces in each grid.

In some embodiments, a separate black link space, not to be confused with the black spaces, can comprise a location where a black game piece is placed if a team, by the game's rules, becomes "chinked." The black link space can essentially comprise a penalty indicator that signals to the rest of the teams when a certain team has been penalized.

In some embodiments, the game further comprises a timer [20] configured to count down time, the timer [20] comprising three buttons disposed on a top portion of the timer [20], specifically, a first control button [25] for initiating the timer according to a first predetermined time limit, a second control button [26] for initiating the timer according to a second predetermined time limit, and a third control button [27] for initiating the timer according to a third predetermined time limit, the timer [20] further comprising a face [28] located on a first side of the timer [20], the face [28] effective for displaying the time remaining during a player's turn, where the timer [20] is effective for alerting the players when the player's turn has expired, where each time limit corresponds to a countdown, and where the timer can be stopped when any of the control buttons is depressed a first time during the countdown of any of the time limits, and where the timer can be reset when any of the control buttons is depressed a second time during the countdown of any of the time limits.

In some embodiments, a fourth control button is disposed on the timer which acts as a stop/reset button apart from the timer limit control buttons.

The aforementioned timer can comprise any standard timer readily available in the public market and well known to one skilled in the art of board game construction and methodology. It would further understood by one skilled in the art that the timer could also comprise a sand timer, or other non-digital forms of timers commonly used for board guessing games requiring a timer device. In some embodiments the timer can have three different time limit settings corresponding to buttons disposed on the face of the timer. In some embodiments, the time limits are 20 seconds, 40 seconds, and 60 seconds. For example, to activate the timer for a 20 second time limit, a user must depress the 20 second time limit button which would start the timer for a 20 second countdown.

In some embodiments, the game further comprises five colored chains [30] and one black chain, the colored chains comprising a first chain having a first color, a second chain having a second color, a third chain having a third color, a fourth chain having a fourth color and a fifth chain having a fifth color, each of the colored chains [30] and the black chain comprising a length ranging between 0.06 feet and 5 feet, the colored chains [30] and black chain effective for placement on the game board and capable of manipulation in order to represent words, shapes or objects.

In some embodiments, the chains can comprise a length ranging from 0.06 to 0.12 feet. In some embodiments, the chains can comprise a length ranging from 0.06 to 0.5 feet. In some embodiments, the chains can comprise a length ranging from 0.5 to 1 foot. In some embodiments, the chains can comprise a length ranging from 0.5 to 3 feet. In some embodiments, the chains can comprise a length ranging from 0.5 to 5 feet. In some embodiments, the chains can comprise a length ranging from 0.5 to 10 feet. In some embodiments, the chains can comprise a length ranging from 0.5 to 20 feet. In some embodiments, the chains can comprise a length ranging from 1 foot to 10 feet. In some embodiments, the chains can comprise a length ranging from 1 foot to 30 feet.

In some embodiments, the game further comprises a deck of 200 cards [35], each card in the deck comprising a first side [31] and a second side [32], the first side [31] having a game label at the center-most position of the first side [31], the second side [32] having a set of four predetermined words inscribed on the second side [32] wherein no set of four words on any of the cards in the deck of cards is the same.

In the aforementioned embodiment, each card contains four different words, each word corresponding to a color. During a team's turn, the chain handler draws one of the cards, and unless the team's game pieces is on a black space, the chain handler must use the word with the color identical to the color where the team's game piece is situated for that turn. If the team's game piece is located on a black space, the chain handier can choose any of the words on the card and try to have the team guess the word the chain handler chose. Thereafter, the team must try to have their chain handler shape the team's chain to represent the word, so that the team might guess the word the chain handler shapes with the chain before the time on the timer expires.

In some embodiments, the game further comprises five game pieces [21] where each game piece [21] comprises a chain link [201] and a cross platform [202], where a bottom side of the chain link [201] is fixedly attached to a top side of the cross platform [202], the game pieces effective for placement on one of the board spaces [15] and each game piece [21] corresponding to one of the grids.

The aforementioned embodiment describes novel game pieces which further add to the chain design of the game. The game pieces are made to represent links on a chain.

In some embodiments, the game can be played as follows:

i) players group into four teams, each team corresponding to a color, where one of the players is a chain handler responsible for manipulation of the chain;

ii) each of the teams is assigned one of the game pieces, and one of the grids;

iii) each of the teams places their respective game pieces on the start space of the team's grid;

iv) one of the teams takes a turn by drawing one of the cards from the plurality of cards, one of the players on the team activates the timer, thereafter, while the timer is ticking down, the chain handler draws, using the chain, a specific word corresponding to the color of the team from the second side of the card drawn and the chain handler's team must guess the word before the timer runs out, and thereafter, depending on the whether the team correctly guesses the word, and depending on the time it takes for the team to guess the word, the team must move forward or backward a predetermined number of board spaces;

v) where the team lands on a black space, the team may choose any of the words on the second side of the card drawn.

In some embodiments, one of the teams takes a turn by deciding which team member will be the Chain Handler. The Chain Handler then draws a card of the top of the plurality of cards, and reviews the word or phrase which is comprised of a color identical to the color of the board space where the team's game piece is situated. Thereafter, the Chain Handler must choose one of three time limits for the teams turn, where the time limit determines the amount of time the team has, according to the timer, to guess the word or phrase the Chain Handler models with the chain. Next, the Chain Handler, tells the predetermined time keeper to set the timer to the Chain Handler's choice of time limits. The time keeper then initiates the timer, and the Chain Handler must model the chain to, and the chain handler's team must guess, within the chosen time limit, the word or phrase the Chain Handler has been assigned by the card drawn. Thereafter, the Chain Handler's team moves forward or backwards depending on the time limit chose and whether or not the word/phrase was guessed correctly.

The teams can progress their game pieces along the interconnected board spaces in each of the teams respective grids until one of the team's game piece lands on the end game space.

In some embodiments, referring to FIG. 1, the game board can be constructed as follows. Each grid comprises 34 board spaces, including the Cha-Doodle space. Each 5th, 10th, 17th, and 26th, board spaces, starting from the start board space is outlined in black. Each start space represents one of four colors: yellow, red, green or blue. The color of the start space determines the color sequence of the additional board spaces in each grid. For example, if the start space is red, then the space following the start space is green, then yellow, than blue, then red again and the color sequence of the remaining spaces is consistent with this orientation until the end of the interlinking board spaces in that grid. As another example, if the start space is blue, the color sequence, is blue, red, green, yellow, and blue again. In said embodiment, each of tie grids also represents a particular color. If the start space is red, then the "Cha-Doodle" word and directional arrows are also red and the black space is outlined in red.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A game, effective for stimulating enjoyment and interaction between family and friends, the game comprising:

a. a game board [10] comprising a flat front surface, a center block [150] comprising a first side [16], second side [17], third side [18], and fourth side [19], the center block further comprising a first center block corner [11], a second center block corner [12], a third center block corner [13] and a fourth center block corner [14], the center block bordered by an outer block [151], the outer block [151] comprising a first outer block corner [110], a second outer block corner [120], a third outer block corner [130] and a fourth outer block corner [140], the game board further comprising a first path [401] formed by a straight line extending from the first center block corner [11] to the first outer block corner [111], the game board further comprising a second path [402] formed by a straight line extending from the second center block corner [12] to the second outer block corner [112], the game board further comprising a third path [402] formed by a straight line extending from the third center block corner [13] to the third outer block corner [113], the game board further comprising a fourth path [404] formed by a straight line extending from the fourth center block corner [14] to the fourth outer block corner [114], the game board further comprising a first trapezoid grid [471] formed by the first center block side [16], the first outer block side [116], the first path [401], and the fourth path [404], the game board further comprising a second trapezoid grid [471] formed by the second center block side [17], the second outer block side [117], the first path [401] and the second path [402], the game board further comprising a third trapezoid grid [473] formed by the third center block side [18], the third outer block side [118], the second path and the third path [403], the game board further comprising a fourth trapezoid grid [474] formed by the fourth center block side [19], the fourth outer block side [119], the third path [403] and the fourth path [404], the first trapezoid grid [471] comprising a first horizontal line [411] extending from the first path [401] to the fourth path [404] at a first distance from the center block [150], the first trapezoid grid [471] comprising a second horizontal line [412] extending from the first path [401] to the fourth path [404] at a second distance from the center block [150], the first trapezoid grid [471] comprising a third horizontal line [413] extending from the first path [401] to the fourth path [404] at a third distance from the center block [150], the first trapezoid grid [471] comprising a fourth horizontal line [414] extending from the first path [401] to the fourth path [404] at a fourth distance from the center block [150];

the second trapezoid grid [472] comprising a first horizontal line [421] extending from the first path [401] to the second path [402] at the first distance from the center block [150], the second trapezoid grid [472] comprising a second horizontal line [422] extending from the first path [401] to the second path [402] at the second distance from the center block [150], the second trapezoid grid [472] comprising a third horizontal line [423] extending from the first path [401] to the second path [402] at the third distance from the center block [150], the second trapezoid grid [472] comprising a fourth horizontal line [424] extending from the first path [401] to the second path [402] at the fourth distance from the center block [150];

the third trapezoid grid [473] comprising a first horizontal line [431] extending from the second path [402] to the third path [403] at the first distance from the center block [150], the third trapezoid grid [473] comprising a second horizontal line [432] extending from the second path [402] to the third path [403] at the second distance from the center block [150], the third trapezoid grid [473] comprising a third horizontal line [433] extending from the second path [402] to the third path [403] at the third distance from the center block [150], the third trapezoid grid [473] comprising a fourth horizontal line [434] extending from the second path [402] to the third path [403] at the fourth distance from the center block [150];

the fourth trapezoid grid [474] comprising a first horizontal line [441] extending from the third path [403] to the fourth path [404] at the first distance from the center block [150], the fourth trapezoid grid [474] comprising a second horizontal line [442] extending from the third path [403] to the fourth path [404] at the second distance from the center block [150], the fourth trapezoid grid [474] comprising a third horizontal line [443] extending from the third path [403] to the fourth path [404] at the third distance from the center block [150], the fourth trapezoid grid [474] comprising a fourth horizontal line [444] extending from the third path [403] to the fourth path [404] at the fourth distance from the center block [150], the game board [10] further comprising a first series of interlinking board spaces disposed within the first trapezoid grid [471], the first series further comprising, a start space [201] comprising a first color which is the first of the interlinking board spaces [15] and an end game space [202] which is the final board space, and a first plurality of black spaces [203] disposed at predetermined locations within the first series, the game board [10] further comprising a second series of interlinking board spaces disposed within the second trapezoid grid [472], the second series further comprising, a start space [201] comprising a second color which is the first of the interlinking board spaces [15] and the end game space [202] which is the final board space, and a second plurality of black spaces [203] disposed at predetermined locations within the second series, the game board [10] further comprising a third series of interlinking board spaces disposed within the third trapezoid grid [473], the third series further comprising, a start space [201] comprising a third color which is the first of the interlinking board spaces [15] and the end game space [202] which is the final board space, and a third plurality of black spaces [203] disposed at predetermined locations within the third series, the game board [10] further comprising a fourth series of interlinking board spaces disposed within the fourth trapezoid grid [474], the fourth series further comprising, a start space [201] comprising a fourth color which is the first of the interlinking board spaces [15] and the end game space [202] which is the final board space, and a fourth plurality of black spaces [203] disposed at predetermined locations within the fourth series, said interlinking board spaces [15] in each series forming a chain weaving from an outer corner of each of the respective grids to the center block [150];

b. a timer [20] configured to count down time, the timer [20] comp, three buttons disposed on a top portion of the timer [20], specifically, a first control button [25] for initiating the timer according to a first predetermined time limit, a second control button [26] for initiating the timer according to a second predetermined time limit, and a third control button [27] for initiating the timer according to a third predetermined time limit, the timer [20] further comprising a face [28] located on a first side of the timer [20] the face [28] effective for displaying the time remaining during a player's turn, where the timer [20] is effective for alerting the players when the player's turn has expired, where each time limit corresponds to a countdown, and where the timer can be stopped when any of the control buttons is depressed a first time during the countdown of any of the time limits, and where the timer can be reset when any of the control buttons is depressed a second time during the countdown of any of the time limits;

c. a chain [30] comprising a length ranging between 0.06 feet and 5 feet, the chain [30] effective for placement on the game board and capable of manipulation in order to represent words, shapes or objects;

d. a deck of 200 cards [35], each card in the deck comprising a first side [31] and a second side [32], the first side [31] having a game label at the center-most position of the first side [31], the second side [32] having a set of four predetermined words inscribed on the second side [32], wherein each of the four predetermined words is inscribed in either the first color, the second color, the third color, or the fourth color, wherein no set of four words on any of the cards in the deck of cards is the same;

e. a first game piece [21] comprising the first color, a second game piece [21] comprising the second color, a third game piece [21] comprising the third color, a fourth game piece [21] comprising the fourth color, and a fifth game piece [21] comprising a fifth color, where each game piece [21] comprises a chain link [201] and a cross platform [202], where a bottom side of the chain link [201] is fixedly attached to a top side of the cross platform [202], the game pieces effective for placement on one of the board spaces [15] and each game piece [21] corresponding to one of the grids;

wherein the game is played as follows:

i) players group into four teams, each team corresponding to a color, where one of the players is a chain handler responsible for manipulation of the chain, ii) each of the teams is assigned one of the game pieces, and one of the grids, iii) each of the teams places their respective game pieces on the start space of the team's grid, iv) one of the teams takes a turn by deciding which team member will be the Chain Handler, the Chain Handler then draws a card from the top of the deck of cards, and reviews a word or phrase which is comprised of a color identical to the color of the board space where the team's game piece is situated and thereafter, the Chain Handler must choose one of the time limits for the team's turn, where the time limit determines the amount of time the team has, according to the timer, to guess the word or phrase the Chain Handler models with the chain, the Chain Handler then tells a predetermined time keeper to set the timer to the Chain Handler's choice of time limits, the time keeper then initiates the timer, and the Chain Handler must model the chain to, and the chain handler's team must guess, within the chosen time limit, the word or phrase the Chain Handler has been assigned by the card drawn, thereafter, the Chain Handler's team moves forward or backwards a predetermined number of board spaces depending on the time limit chosen and whether or not the word/phrase was guessed correctly, v) where if the team lands on a black space, the team may choose any of the words on the second side of the card drawn, where the teams progress the game piece along the interconnected board spaces in each of the teams respective grids until one of the team's game piece lands on the end game space.

2. The game of claim 1 wherein the predetermined words are replaced with phrases.

3. The game of claim 1 wherein the chain comprises plastic, metal, rubber or paper.

4. The game of claim 1 wherein the fifth color is black.

5. The game of claim 1 where the first color, second color, third color, and fourth color comprise either red, blue, green, yellow, orange, purple, or white.

* * * * *